US005924817A

United States Patent [19]

Godbersen

[11] Patent Number: 5,924,817

[45] Date of Patent: Jul. 20, 1999

[54] APPARATUS ON A CONCRETE SLIP FORMING MACHINE FOR INSERTING DOWEL BARS WITHIN A SPLIT PAN HAVING CRITICAL DIMENSIONS

[75] Inventor: Gary L. Godbersen, Ida Grove, Iowa

[73] Assignee: Gomaco Corporation, Ida Grove, Iowa

[21] Appl. No.: 08/935,506

[22] Filed: Sep. 23, 1997

Related U.S. Application Data

[63] Continuation-in-part of application No. 08/871,800, Jun. 9, 1997, which is a continuation-in-part of application No. 08/689,795, Aug. 13, 1996, abandoned.

[51] Int. Cl.[6] ..... E01C 23/04

[52] U.S. Cl. ..... 404/88; 404/100

[58] Field of Search ..... 404/87, 88, 100, 404/105, 114, 118

[56] References Cited

U.S. PATENT DOCUMENTS

| | | |
|---|---|---|
| 2,295,947 | 12/1942 | Heltzel . |
| 4,433,936 | 2/1984 | Moser . |
| 4,798,495 | 1/1989 | Laeuppi et al. . |
| 4,799,820 | 1/1989 | Laeuppi et al. . |
| 5,190,397 | 3/1993 | Bengford et al. . |
| 5,209,602 | 5/1993 | Godbersen . |
| 5,318,377 | 6/1994 | Swisher, Jr. et al. . |
| 5,388,927 | 2/1995 | Ulmer et al. . |
| 5,405,212 | 4/1995 | Swisher . |

FOREIGN PATENT DOCUMENTS

| | | |
|---|---|---|
| 0 117 323 A1 | 9/1984 | European Pat. Off. . |
| 0196698 | 2/1986 | European Pat. Off. . |
| 0196698 | 5/1986 | European Pat. Off. . |
| 3811186 | 1/1989 | Germany . |
| 247993 | 3/1970 | U.S.S.R. . |
| 247993 | 4/1970 | U.S.S.R. ..... 404/88 |
| 247993 | 6/1970 | U.S.S.R. . |

OTHER PUBLICATIONS

Copy of two page brochure entitled GOMACO DBI 650 by GOMACO Corporation, 1984.

Copy of ten page brochure entitled HW–165 Slipform Paver by GOMACO Corporation.

Copy of two page brochure entitled DBI 650 Dowel Bar Inserter by GOMACO Corporation.

Copy of eight page brochure entitled GP–2500 Full–Width Slipform Paver by GOMACO Corporation, dated 1987.

*Primary Examiner*—James A. Lisehora

*Attorney, Agent, or Firm*—Henderson & Sturm

[57] ABSTRACT

An apparatus for inserting dowel bars into a concrete slab in association with a slip forming machine of a type having a frame with a mold attached thereto for shaping uncured concrete into a continuous concrete slab. The mold having a front and rear pan portion with a space therein completely across the mold. A dowel bar inserter having individual fork assemblies is disposed above this space in the pan for pushing the dowel bars down into the formed concrete slab, preferably all at one time. The dowel bar inserter is adjustable and removable. If removed, the forward and rear pan portions of the mold can be bolted together instead of being spaced apart. The front pan portion is greater than three feet long. The rear pan portion is greater than two feet long and the front pan portion is preferably longer than the rear pan portion.

6 Claims, 15 Drawing Sheets

APPARATUS ON A CONCRETE SLIP FORMING MACHINE FOR INSERTING DOWEL BARS WITHIN A SPLIT PAN HAVING CRITICAL DIMENSIONS

CROSS-REFERENCE TO RELATED APPLICATIONS

This is a continuation-in-part, application Ser. No. 08/871,800, filed on Jun. 9, 1997, entitled APPARATUS FOR INSERTING DOWEL BARS WITHIN THE PAN OF A CONCRETE SLIP FORMING MACHINE which is a continuation-in-part of Ser. No. 08/689,795 filed Aug. 13, 1996, entitled APPARATUS FOR INSERTING DOWEL BARS IN A CONCRETE SLIP FORMING MACHINE now abandoned.

STATEMENT REGARDING FEDERALLY SPONSORED RESEARCH OR DEVELOPMENT

Not Applicable.

MICROFICHE APPENDIX

Not Applicable.

BACKGROUND OF INVENTION

1. Field of Application

The present invention relates generally to an apparatus for slip forming concrete using a pan which initially begins the concrete forming process of such a machine and to an apparatus for inserting dowel bars for a concrete slip forming machine, and more particularly to such a method and apparatus which inserts dowel bars directly between spaced apart portions of the pan of such machine, instead of utilizing a separate dowel bar insertion device disposed behind the pan, which has been the custom of the prior art. Additionally, the front portion of the pan which is in front of the dowel bar inserter is greater than three feet in length and the rear portion of the pan which is behind the dowel bar inserter is greater than two feet long.

2. Description of Prior Art

In concrete slip forming machines used for constructing roads and the like, it is customary to form joints therein at predetermined intervals. One of the reasons for these joints is to transfer stresses between adjacent sections of the concrete slabs through the use of dowel bars placed within the slab. Another reason for the joints is to allow for expansion and contraction of the slabs, which occurs during freezing and thawing cycles. The joints are generally perpendicular with respect to the length of the slab and direction of forward movement of the machine. The joints may also extend across the width of the slab at an angle, which is commonplace in present day road construction so that each set of tires of a vehicle does not hit the joint at precisely the same time, thereby lessening the thumping problem that often occurs when the concrete joints are perpendicular to the direction of the movement of the vehicle traveling thereon.

The dowel bars are typically inserted into the concrete at one-third to one-half the depth of the slab down from the top surface of the slab and are generally aligned with the forward movement of the machine. The dowel bars are also usually epoxy coated to prevent rusting of the bars and are usually coated with a film oil to prevent the concrete from bonding to the surface of the bars. After the concrete has set, a saw is used to cut a joint in the concrete above and perpendicular to the dowel bars. The saw-cuts control the shrinkage cracking of the concrete during the final curing stage of the concrete by allowing the concrete to crack more easily along the saw cut joints. The concrete slabs are therefore able to move independently as they expand and contract during temperatures changes but the dowel bars joining the slabs are still able to transfer the shear stresses from slab to slab as motor vehicles pass over the slabs.

The aforementioned concrete slip forming machines have for many years used dowel bar insertion mechanisms to place the dowel bars within the concrete as the slab is being formed, for example like those shown in U.S. Pat. Nos. 4,798,495 and 4,799,820, both by Laeuppi, et al., both of which are incorporated herein by reference.

Conventional dowel bar inserting equipment is attached to the frame of a slip forming machine behind the pan or mold, for example as shown in U.S. Pat. No. 5,190,397 to Bengford, which patent is incorporated herein by reference. By utilizing this prior art technology with the dowel bar insertion mechanism located behind the pan, the concrete slab, which has already been formed, shaped and smoothed by the pan, is disturbed considerably by the insertion of the dowel bars therein. This disruption of the smoothed concrete surface is often referred to in the industry as "scaring" of the surface. The scaring of the surface, due to the insertion of the dowel bars into the formed, slab creates a need for an additional troweling procedure following the dowel bar insertion mechanism to repair the scaring. Such a trowel is shown in U.S. Pat. No. 5,061,115 to Godbersen, et al. Additionally, a vibrating screed or tamper bar must precede the trowel on such a machine in order to consolidate the concrete back around the inserted dowel bar.

The need to have this dowel bar inserting apparatus and accompanying trowel mechanism makes it necessary to lengthen the machine by a considerable amount. This additional length creates many problems such as making the machine more difficult to move and requiring much more time to assemble and disassemble as these machines are moved from one job site to the other. Additionally, on roads that have sharp vertical curves up or down, if the paver is too long, it may not correctly pave the surface thereunder. For example, on a sharp downward vertical curve, the paver may span completely across such a low spot resulting in the paver not being capable of reaching low enough to maintain a uniform slab thickness. Alternatively, on a sharp upward vertical curve, the paver may extend completely across the high spot leaving only a thin layer of concrete. Furthermore, a machine which has a conventional dowel bar inserter thereon and a follow-up trowel mechanism almost always needs to be a four-track machine, which increases the costs of manufacture and use over that of a two-track machine, and also causes the aforementioned problem relating to the difficulty of being able to pave roads which have sharp vertical curves up and down.

U.S. Pat. No. 5,209,602, issued May 11, 1993 to Gary L. Godbersen, which is incorporated herein by reference, solved many of the aforementioned problems. The present invention is an improvement thereto since it has been determined that it is better to form a wide space in the pan rather than to merely have openings which extend therethrough for inserting dowel bars, since the concrete tends to flow up through the openings in the pan.

Consequently, there is a need for a method and apparatus for inserting dowel bars on a concrete slip forming machine which will overcome the aforementioned disadvantages of the prior art.

SUMMARY OF THE INVENTION

The present invention relates generally to an apparatus for inserting dowel bars into a concrete slab in association with a slip forming machine of a type having a frame with a pan attached thereto for forming uncured concrete into a continuous concrete slab. The pan itself has a space disposed therein completely across the pan. Dowel bar retainers are disposed above this space in the pan for holding dowel bars in readiness to be inserted into the concrete slab. A dowel bar inserter is disposed above each of the dowel bar retainers for pushing the dowel bars down. The dowel bars may be pushed into the concrete slab all at one time or alternatively one at a time if it is desired to form a diagonal or skewed joint.

An object of the present invention is to provide an improved method and apparatus for inserting dowel bars into a concrete slab in association with the use of a concrete slip forming machine.

Another object of the present invention is to provide a dowel bar inserting apparatus which does not disturb the concrete slab after it has been formed by the pan of a slip forming machine.

A still further object of the present invention is to provide a dowel bar inserting apparatus within the pan to eliminate the need for a separate troweling operation of the top of the concrete slab after dowel bars have been inserted.

A still further object of the present invention is to provide a dowel bar inserting apparatus which permits a slip forming machine to be much shorter and also permit such a machine to be a two-track machine instead of a longer, more awkward and expensive four-track machine.

A still further object of the present invention is to provide a concrete slip forming machine with a dowel bar insertion apparatus disposed above a space between front and rear portions of the pan, the front and rear portions of the pan being greater than three and two feet long respectively.

A still further object is to provide an apparatus of the aforementioned type which has a device for adjusting the distance between dowel bars and the distance between insertion forks so that an entirely different pan does not need to be used as would be the case if different distances between dowel bars were required in the above mentioned '602 patent.

Still another object of the invention is to provide an apparatus which can have the aforementioned objects achieved and still have an arrangement where a dowel bar inserter can be used or not used in a split pan arrangement.

Other objects, advantages, and novel features of the present invention will become apparent from the following detailed description of the invention when considered in conjunction with the accompanying drawings.

DETAILED DESCRIPTION OF THE INVENTION

Figure 6:
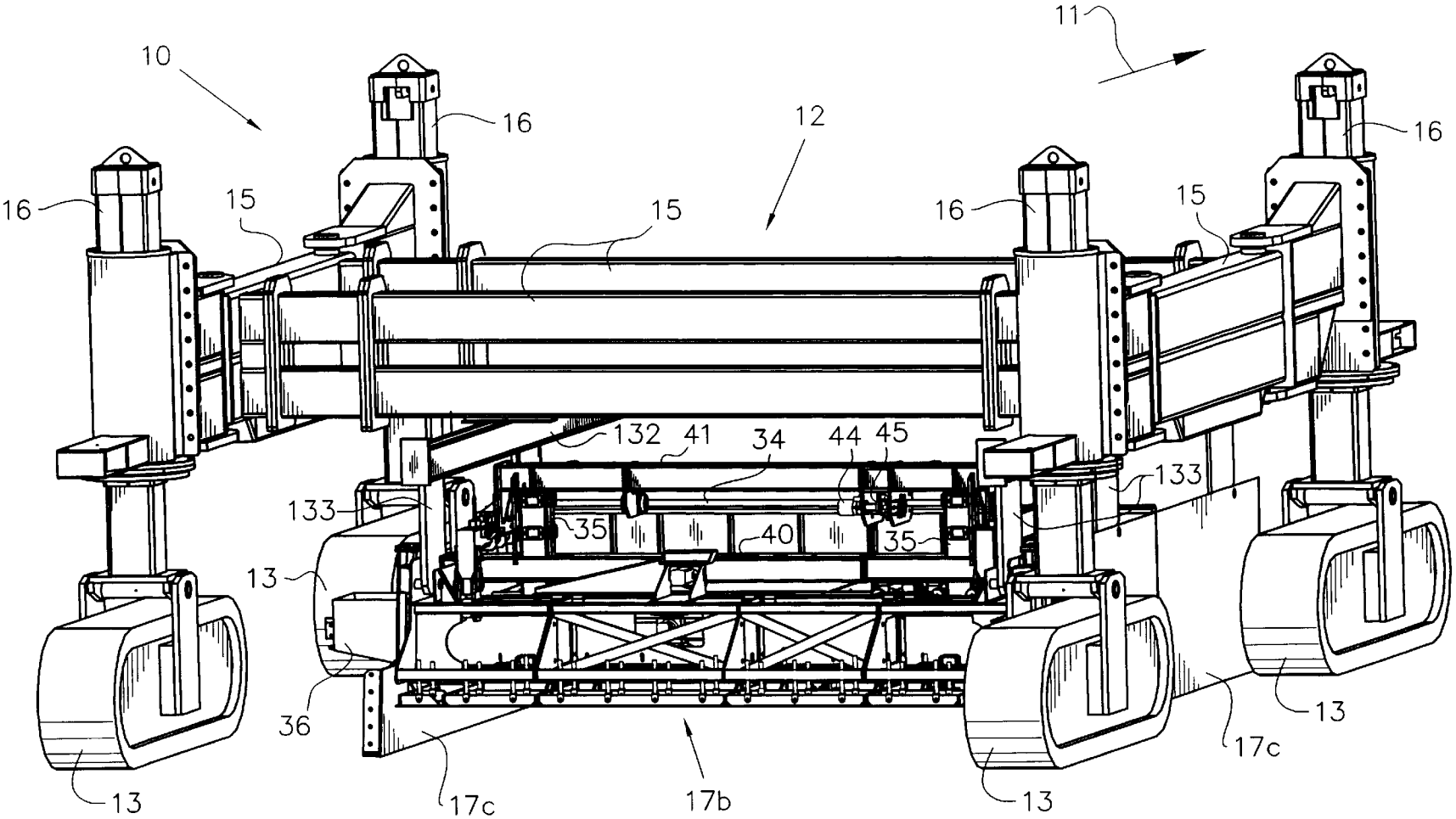
FIG. 6 is a perspective view of a four track slip forming machine of the present invention.
Figure 6A:
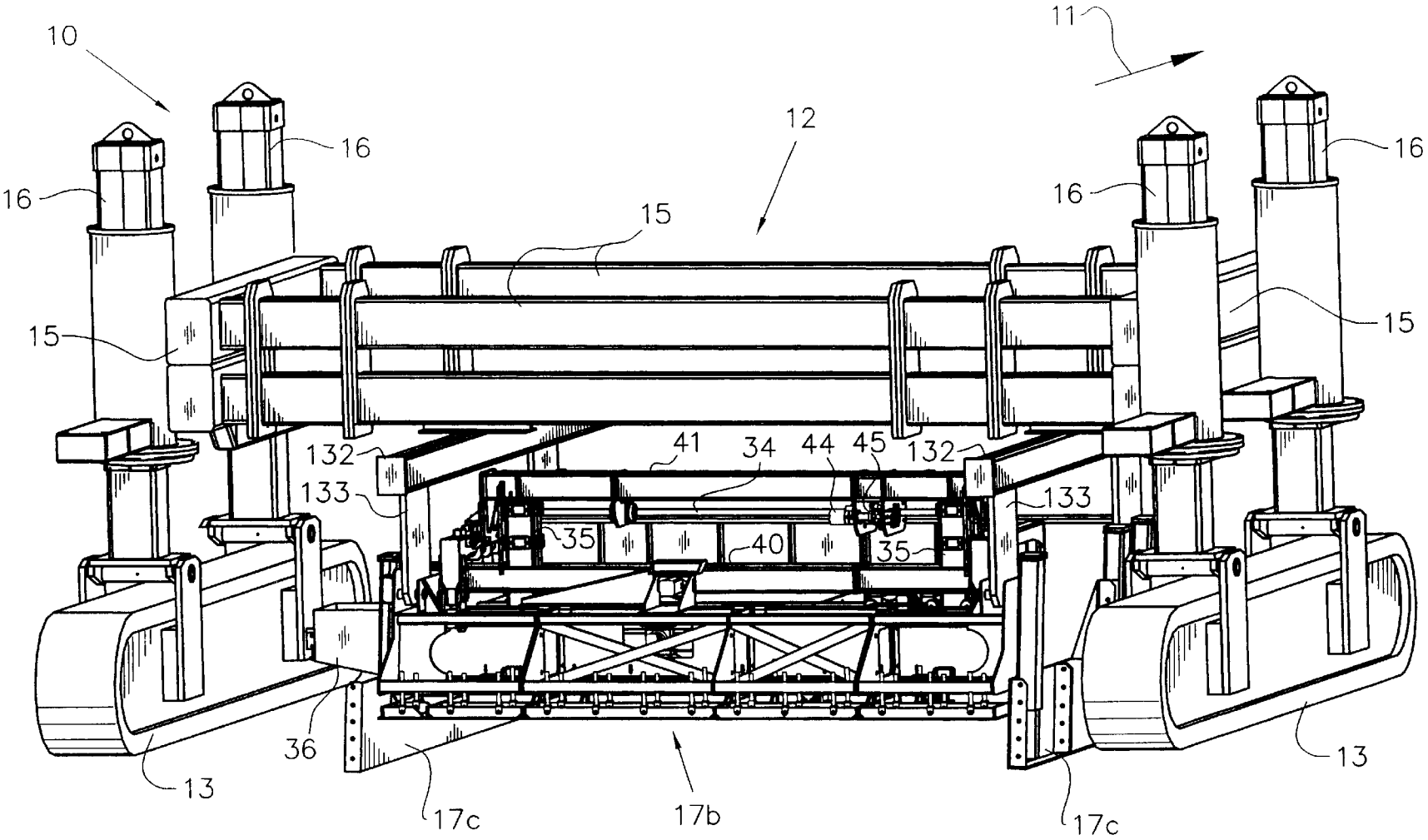
FIG. 6a is a perspective view of a two track slip forming machine of the present invention.

Referring now to the drawings wherein like reference numerals designate identical or corresponding parts throughout the several views, FIGS. 6 and 6a respectively show a four-track and a two-track concrete slip forming machine (10) of the present invention. The machine (10) is comprised of a frame (12) which includes horizontal frame members (15) supported by vertical legs (16). The machine (10) is movable in a forward or rearward direction by hydraulically driven tracks (13) attached to the vertical legs (16). The tracks (13) are pivotally attached to the vertical legs (16) such that the frame (12) remains relatively parallel to the road bed at all times. The frame supports the engine, fuel tank, hydraulic fluid holding tank, as well as all the components and mechanisms used for slip forming the concrete slab (14). In the four-track embodiment of FIG. 6, the vertical legs (16) are placed at the four comers of the machine (10). The legs (16) are pivotally attached to the horizontal frame members (15) to enable each pair of front and rear vertical legs (16) to be turned in unison by hydraulic cylinders and linkages (not shown) such that the machine (10) can follow the road bed along horizontal curves. In the two-track embodiment of FIG. 6a, the vertical legs (16) are rigidly fixed to the frame (12). When it is desired to turn the two-track machine (10) along a horizontal curve, the track (13) on the outside of the curve is caused to rotate faster than the track (13) on the inside of the curve, thus causing the machine (10) to turn about the slower moving track (13).

Throughout this specification, references are often made to "forward" and "rearward" directions. It should therefore be understood that any reference to "forward" or "forwardly" refers to the direction of forward movement of the machine (10) denoted by arrows (11), whereas a reference to "rearward" or "rearwardly" refers to the direction away from the forward movement of the machine (10).

Figure 2:
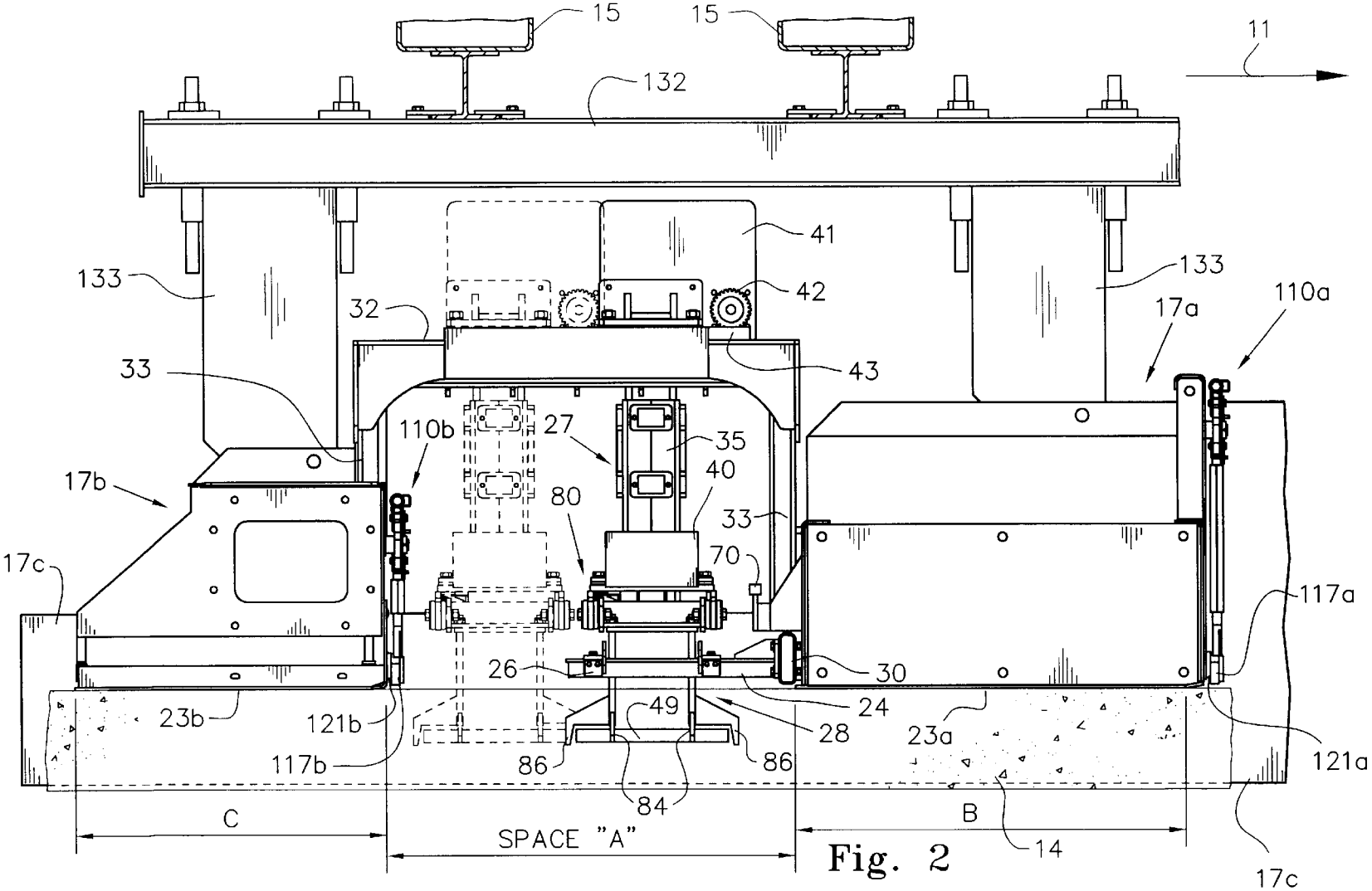
FIG. 2 is a right side elevational view of the dowel bar insertion mechanism and front and rear pan portions and shows the lengths B and C of the front and rear portions of the pan.
Figure 3:
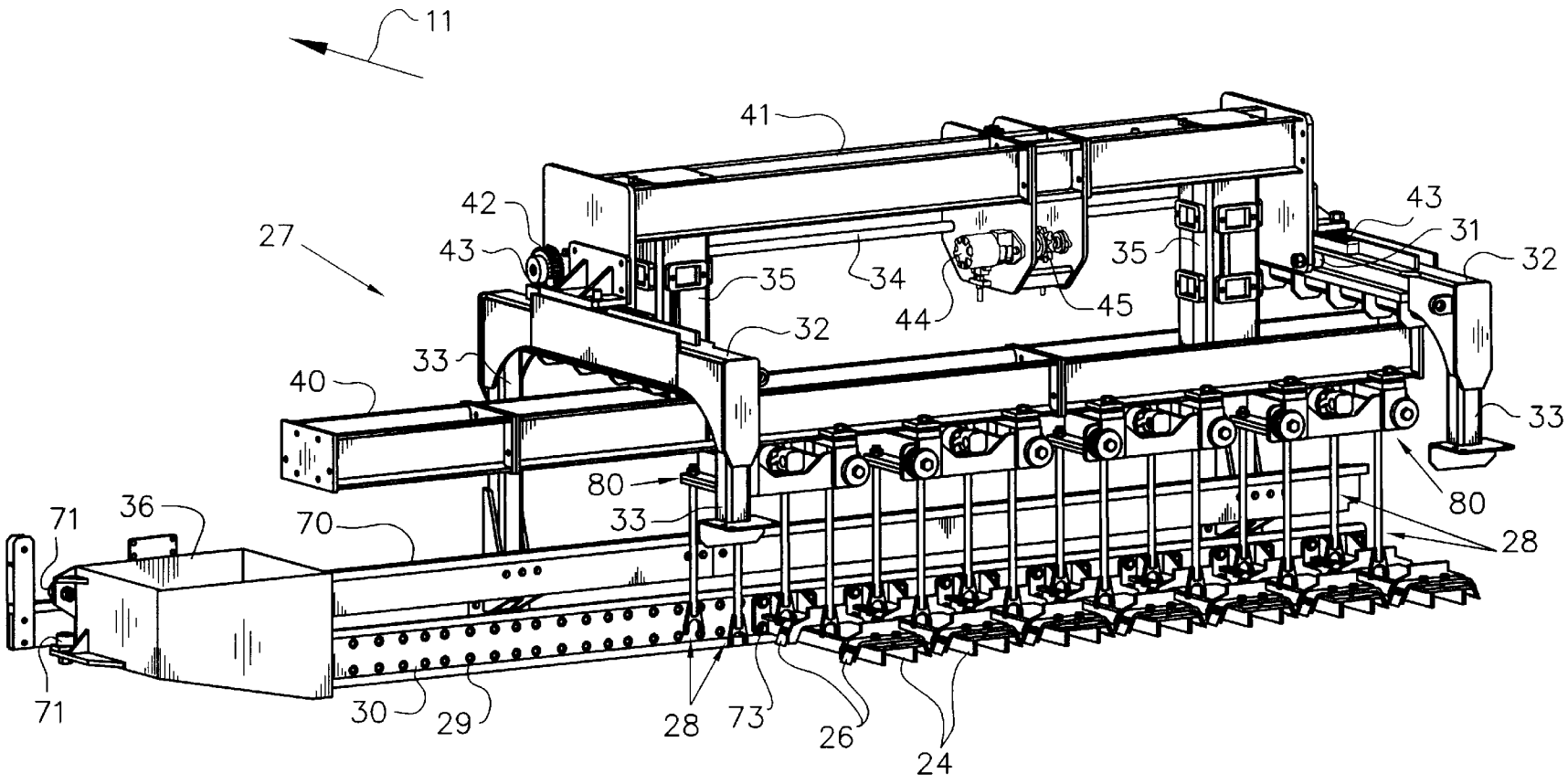
FIG. 3 is a perspective view showing the entire dowel bar insertion mechanism with the rear pan portion removed.
Figure 7:
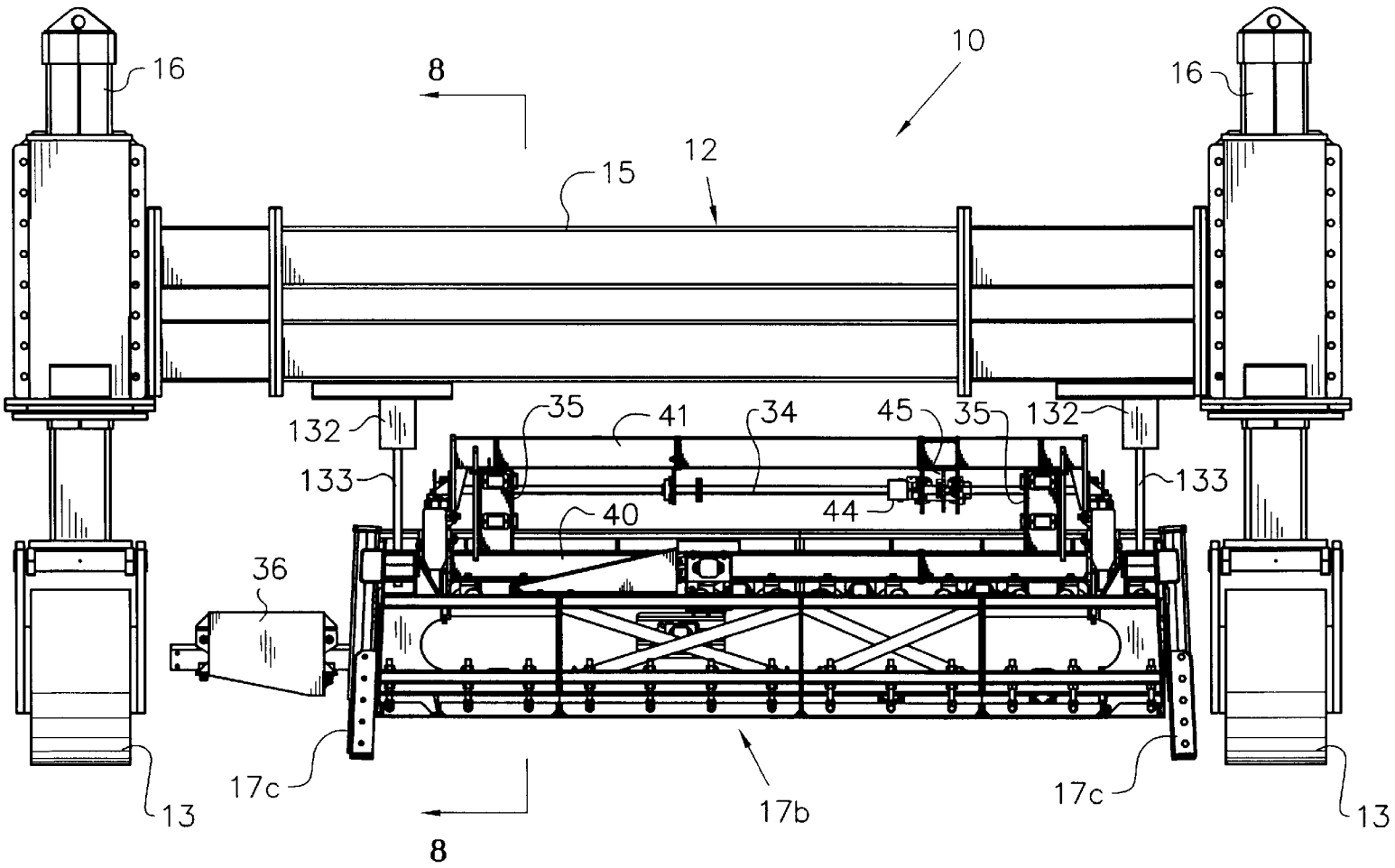
FIG. 7 is a rear elevation view of the entire slip forming machine of the present invention.
Figure 8:
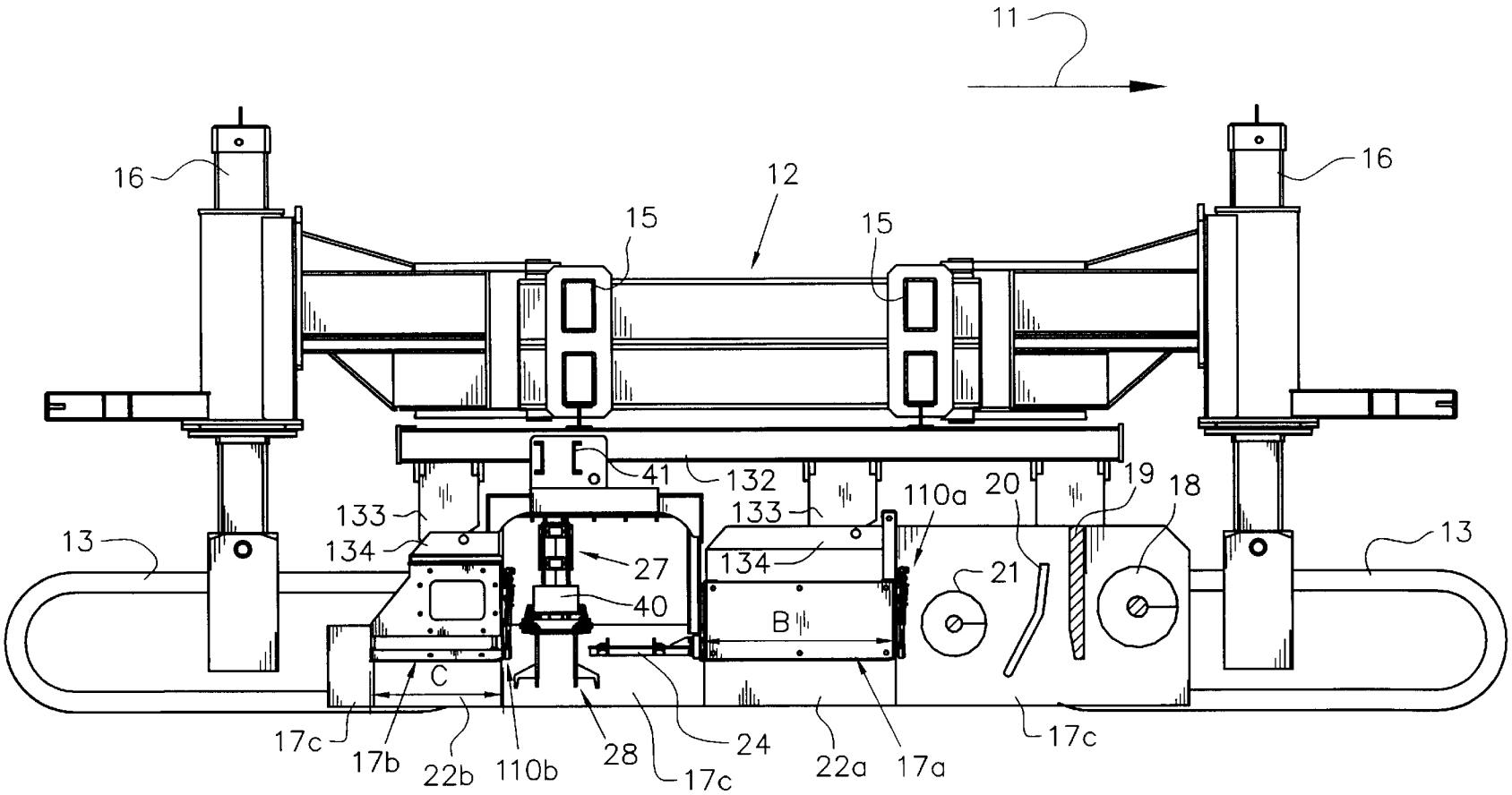
FIG. 8 is a cross-sectional view of the slip forming machine taken along lines 8—8 of FIG. 7.

FIG. 7 shows a rear view of the present invention (10) and FIG. 8, is a cross-sectional view of the concrete slip forming machine (10), taken along lines 8—8 of FIG. 7. In FIG. 8, operably attached to the forward end of the frame (12) is a first auger (18), followed by a strike-off bar (19). Bent paving vibrators (20) are positioned behind the strike-off bar (19), followed by a second auger (21). Following the second auger (21) is the concrete form or mold. The mold includes a split-pan form (17) and side forms (17*c*) (best viewed in FIG. 9). The split-pan form (17) is comprised of a front pan portion (17*a*) and a rear pan portion (17*b*). Referring now to FIG. 2, showing a more detailed side elevation view of the split-pan form (17), the front and rear pan portions (17*a* and 17*b*) have concrete pan forming surfaces (23*a* and 23*b*) which form the top surface of the concrete slab (14). It should be understood that the concrete pan forming surfaces (23*a* and 23*b*) share a common plane that is substantially parallel with the frame (12) and the surface of the road bed. The length of the pan forming surfaces (23*a* and 23*b*) are important, both individually and with respect to each other. The front pan forming surface (23*a*) must be more than three feet (3') long as viewed in FIG. 2 and the optimum length is four feet (4') long (distance "B" in FIGS. 2 and 8). Otherwise, the wet concrete is not properly leveled off to a uniform height to receive the dowel bars. When a three foot long front pan portion is used, the concrete tends to swell up and be higher than the height of (23*a*) immediately behind front pan portion surface (23*a*) (FIG. 2). Also, the rear pan portion surface (23*b*) must be greater than two feet long as viewed in FIG. 2 and the optimum length is three feet long (distance "C" in FIGS. 2 and 8). Otherwise, the surface of the concrete (14) will not be completely smoothed after the dowel bars have been inserted. In its preferred form, the length "B" of front pan forming surface (23*a*) is longer than the length "C" of the rear pan forming surface (23*b*).

The thickness of the concrete slab (14) is controlled by the height of the split-pan form (17) above the road bed. By hydraulically raising or lowering the frame (12) on the vertical legs (16) of the machine (10), the height of the frame (12) above the road bed is raised or lowered. Because the split-pan form (17) is operably connected to the frame (12) by hangers (133) the split-pan form (17) moves up and down with the frame (12) thereby varying the thickness of the slab (14) being laid.

Figure 9:
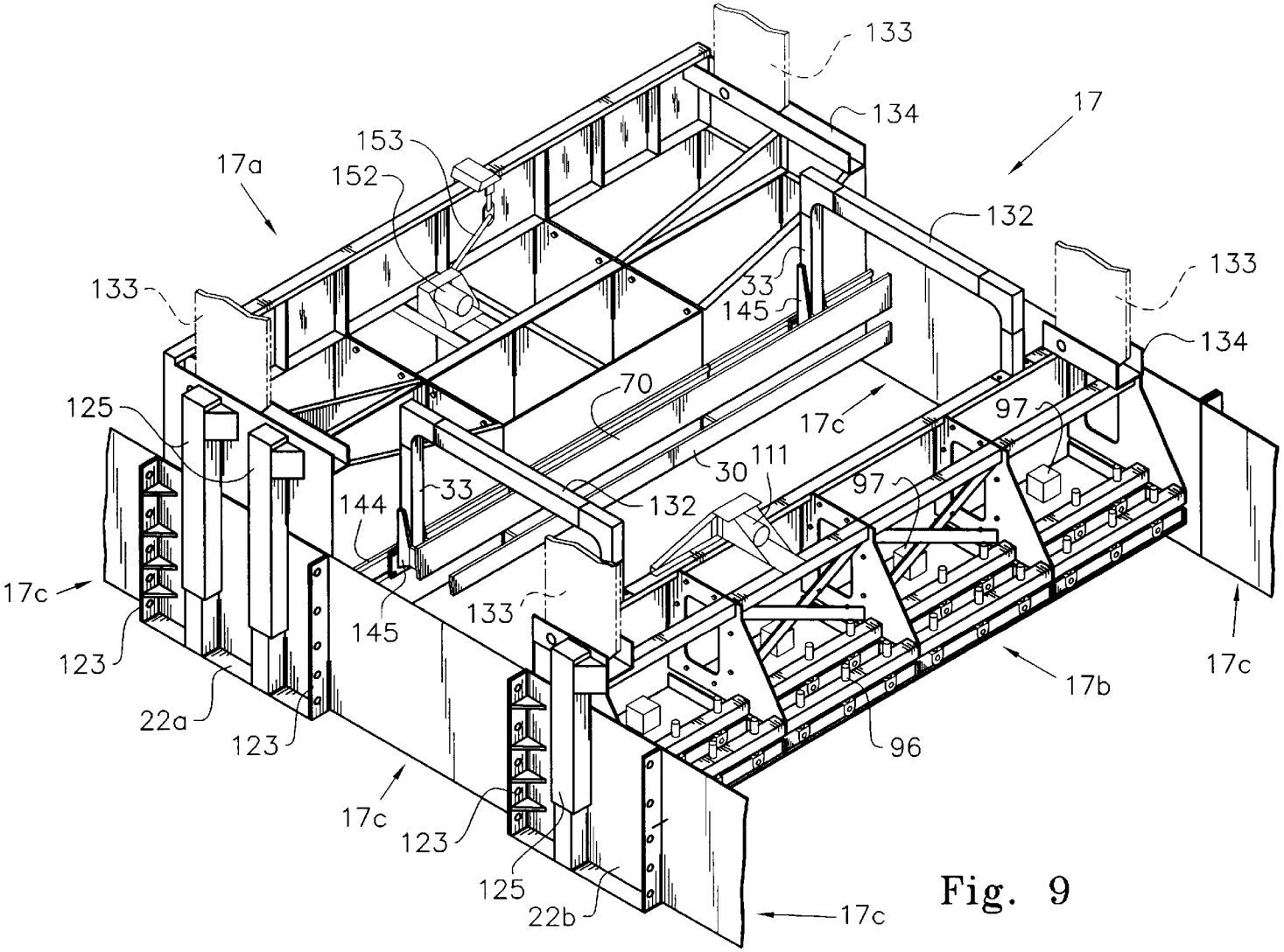
FIG. 9 is a rear perspective view of the front and rear pan portion and side forms.

The side forms (17*c*) are continuous along the length of the machine (10) and act to contain the concrete within a predetermined width as the slab (14) is being formed. The side forms (17*c*) are operably connected to the front and rear pan portions (17*a* and 17*b*) by side form mounts (22*a* and 22*b*) as shown in FIG. 9. The side form mounts (22*a* and 22*b*) include bolting flanges (123). The bolting flanges (123) have apertures (124) formed therein which align with mating apertures in the bolting flanges of the side forms (17*c*). Hydraulic cylinders (125) mounted at the ends of the front and rear pan portions (17*a* and 17*b*) can be actuated to raise or lower the side forms (17*c*) relative to concrete pan forming surfaces (23*a* and 23*b*).

The rear pan portion (17*b*) is comprised of modular sections of predetermined width which can be bolted together to create a rear pan portion (17*b*) of a desired width. The internal structure of each modular section of the rear pan portion (17*b*) includes a plurality of cross braces and stiffeners (91) and gussets (90) to add rigidity. The concrete pan forming surface (23*b*) of the rear pan portion (17*b*) includes a rearward adjustable portion (23*b*') preferably made of stainless steel (see FIG. 1). The rearward adjustable portion (23*b*') is adjusted by the form finish bolts (96). The form finish bolts (96) extend between a first set of horizontal plates (93) rigidly fixed to the adjustable pan portion (23*b*') and a second set of plates (92) rigidly fixed to the gussets (90). By turning the nut (95) on the form finish bolts (96), the form finish bolts (96) will extend or retract, thereby forcing the adjustable concrete pan forming surface (23*b*') up or down to create the desired bevel. The movement of the adjustable concrete pan forming surface (23*b*') is shown in hidden lines greatly exaggerated in FIG. 1.

Also mounted within the rear pan portion (17*b*) are a plurality of hydraulically actuated pan vibrators (97). When in use, these vibrators (97) cause the concrete pan forming surface (23*b*) to vibrate which assists in the finishing process of the concrete as the concrete pan forming surface (23*b*) passes over the concrete. The preferred pan vibrators are of the type manufactured by Minnich Manufacturing Co., Inc. of Mansfield, Ohio. It should be understood that the vibrators are not limited to hydraulically actuated vibrators. Pneumatic or electric pan vibrators will also work for this application.

The front pan portion (17*a*) is also comprised of modular sections of a predetermined width which can be bolted together to create a front pan portion (17*a*) of a desired width. Each modular section of the front pan portion (17*a*) includes a plurality of gussets and stiffeners (142) to add rigidity to the structure. It should be noted that the forward end of the front pan portion (17*a*) includes a higher front plate (143) to prevent concrete from spilling over onto the front of the pan (17*a*). Attached to the rear of the front pan portion (17*a*) is a rail (144). The rail (144) supports the brackets (145) of the vertical struts (33). Attached to the brackets (145) is a trolley support rail (70).

Figure 10:
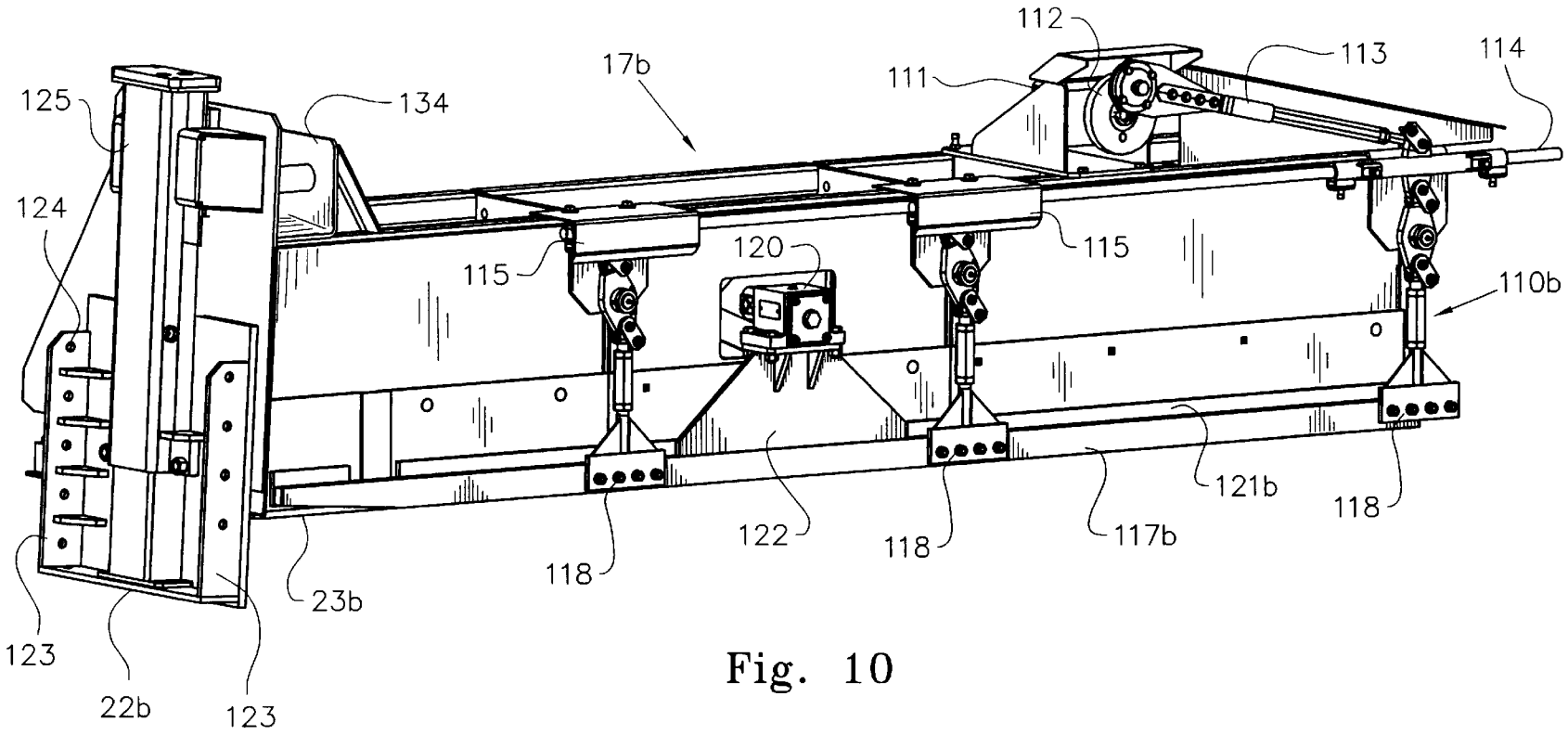
FIG. 10 is a front perspective view of a section of the rear pan portion.
Figure 13:
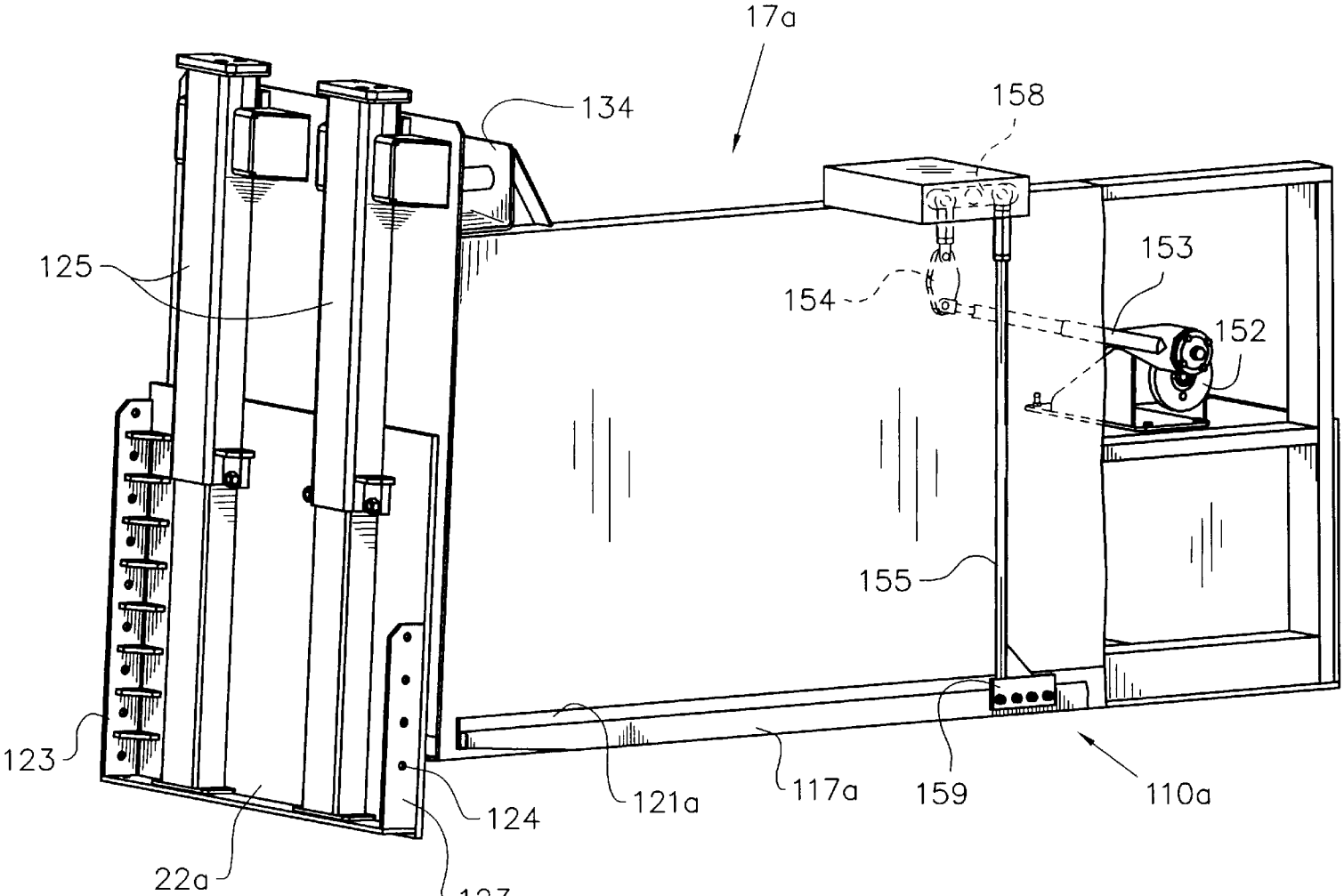
FIG. 13 is a front perspective view of a section of the front pan portion.

Referring again to FIGS. 2 and 9 in conjunction with FIGS. 10 and 13, at the forward end of the front and rear pan portions (17*a* and 17*b*) are tamper bar assemblies (110*a* and 110*b*) respectively. The tamper bar assemblies (110*a* and 110*b*) are used to further level the concrete and bring the cement to the surface of the concrete slab for better finishing. A motor (111) (best viewed in FIG. 9) rotates a wheel (112) to which is attached an arm (113). The rotation of the wheel (112) by the motor (111) causes the arm (113) to move in an elliptical direction both up and down and left to right. The other end of the arm (113) is pivotally linked to a shaft (114) which oscillates within shaft guides (115). Attached to the shaft (114) is a plurality of tamper bar linkages (116) which transfer the oscillating motion of the shaft (114) to the tamper bar (117*b*) through bolted brackets (118). The tamper bar (117*b*) therefore oscillates transversely to the forward direction of the machine (10) across the width of the slab (14). The rear tamper bar assembly (110*b*) also includes a vibrating means. A vibrator (120) is mounted to the rear pan portion (17*b*) to vibrate the tamper bar (117*b*) through a bracket (122) rigidly attached to the tamper bar (117*b*). The action of this oscillating and vibrating tamper bar (117*b*) creates a roll of concrete before the rear pan portion (17*b*) which has been shown to provide a smoother finish to the slab (14) as the concrete pan forming surface (23*b*) passes over it.

As shown in FIG. 13, the front pan portion (17*a*) has a similar tamper bar assembly (110*a*), however the oscillating action is in more of a vertical direction than a horizontal direction. This vertical action is achieved by the use of a motor (151) (best viewed in FIG. 9) which rotates a wheel (152) to which is attached an arm (153). The rotation of the wheel (152) by the motor (151) causes the arm (153) to move in an elliptical direction both up and down and left to right. The other end of the arm (153) is pivotally attached to a vertically disposed linkage (154) which converts the oscillating action of the arm (153) into a more vertical movement. The vertically disposed pivotal linkage (154) is in turn pivotally connected by a rocker arm (158) to a vertical shaft (155) which is attached to the tamper bar (117*a*) through bolted brackets (159).

Wear bars (121*a* and 121*b*) secured to the front and rear pan portions (17*a* and 17*b*) respectively protects the pan portions from wear due to the oscillating action of the tamper bars (117*a* and 117*b*).

Referring back to FIG. 2, between space "A" is a dowel bar insertion mechanism (27), a trolley (36) and dowel bar retainers (24). The trolley (36) is of the type shown in U.S. Pat. No. 5,209,602 to Godbersen, which is incorporated herein by reference, and U.S. Pat. No. 5,190,397 to Bengford, et al., which is also incorporated herein by reference. This structure shown is constructed more like the Bengford, et al., device except that in the preferred embodiment, the dowel bars are inserted in a straight line perpendicular across the length of the slab instead of at an angle as shown in both the Bengford, et al, and the Godbersen preferred embodiments of the aforementioned patents. It would be possible to modify the present invention to enable the dowel bars to be inserted at an angle as shown in the aforementioned Bengford, et al and Godbersen patents by lengthening the machine to accommodate the extra space requirements for such a device. It is also possible to insert the dowel bars at an angle by using the Godbersen '602 device with individual actuators for each fork assembly (80) (to be discussed later). The following specification however, is limited to discussing only the perpendicular dowel bar insertion mechanism.

The trolley (36) rides on rollers (71) along a rail (70) positioned above dowel bar retainers (24). The rail (70) is supported by brackets (145) attached to the rear of the front pan portion (17*a*). The trolley (36) deposits dowel bars (49) into dowel bar retainers (24) at predetermined intervals to be discussed later. When the trolley (36) is not depositing dowel bars (49) into the dowel bar retainers (24), it is positioned outside the side form (17*c*), out of the way of the dowel bar inserting mechanism (27) (best illustrated in FIG. 7).

Figure 11:
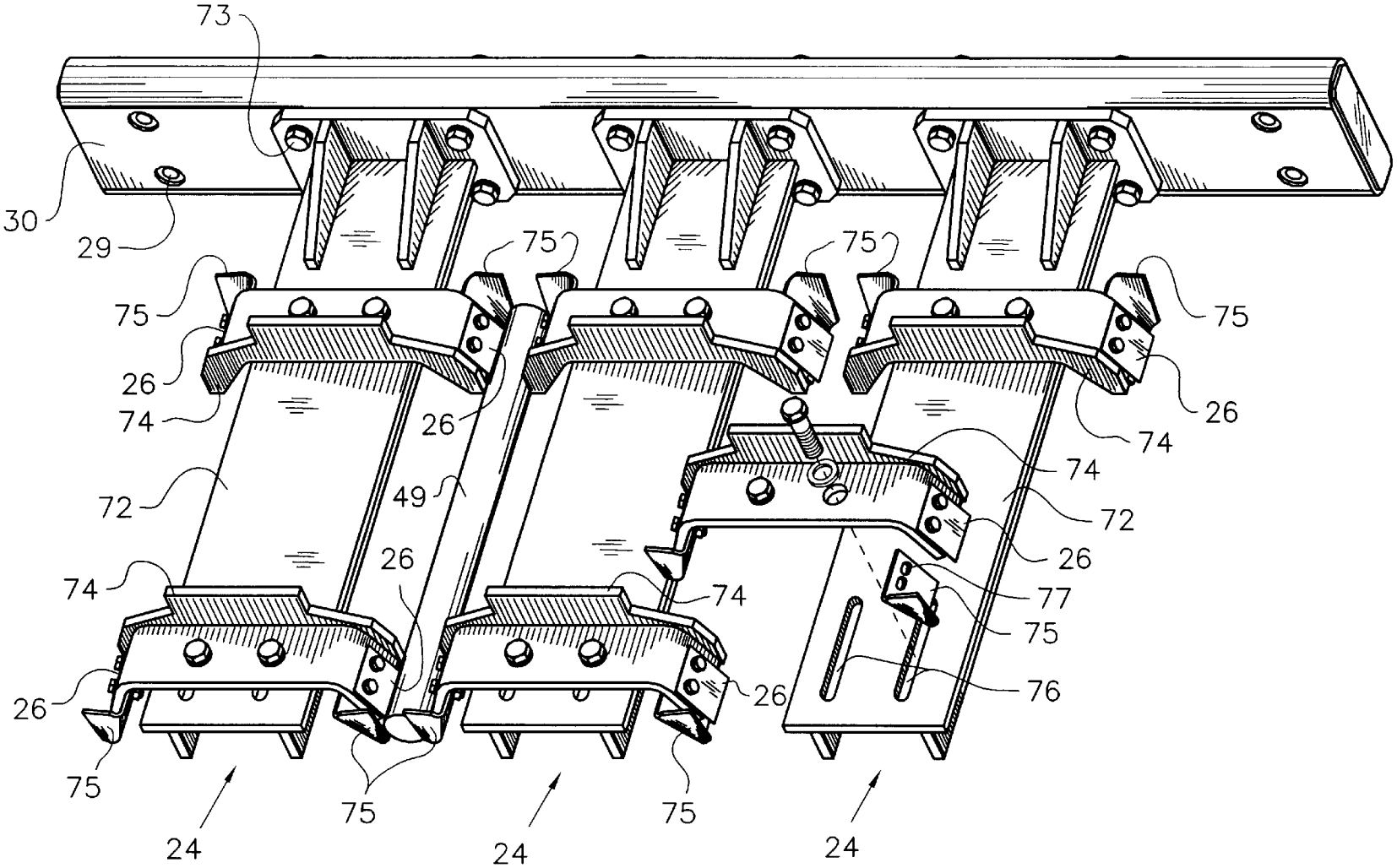
FIG. 11 is a detailed perspective view of one embodiment of the dowel bar retainers.
Figure 11A:
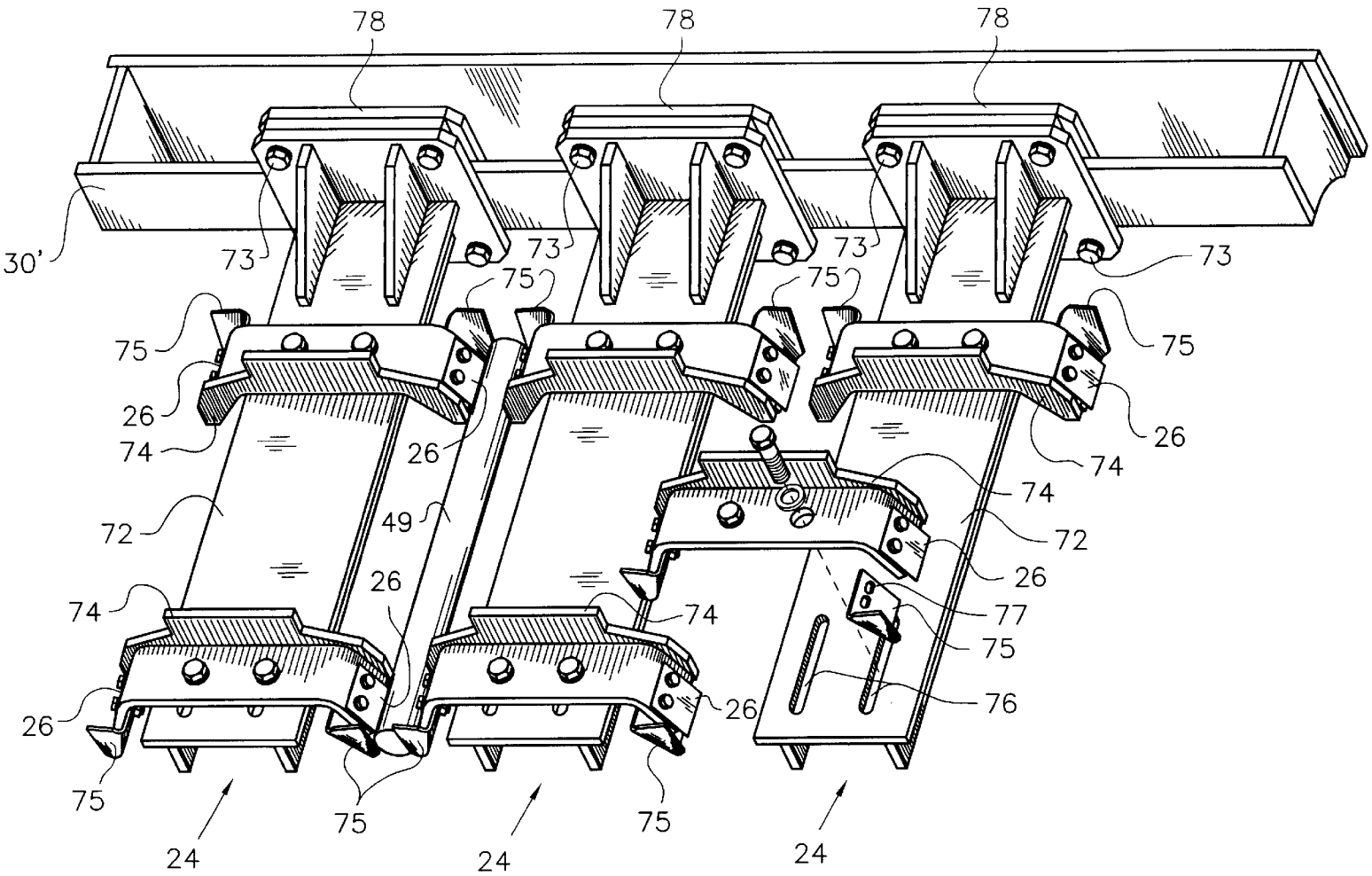
FIG. 11*a* is a detailed perspective view of another embodiment of the dowel bar retainers.

A detailed perspective view of two embodiments of the dowel bar retainers (24) is shown in FIGS. 11 and 11*a*. In FIG. 11, the retainers (24) are comprised of rearwardly cantilevered brackets (72) attached to a beam (30) by bolts (73). The beam (30) is attached rear of the front pan portion (17*a*). The beam (30) has openings (29) therein spaced along its length. Two transverse brackets (74) are bolted to and supported by the cantilever bracket (72). Attached to the ends of the transverse brackets (74) are inwardly projecting resilient spring tabs (26) that are positioned to support the dowel bars (49) between adjacent transverse brackets (74). Also attached to each end of the transverse brackets (74) are L-shaped projections (75) used to longitudinally position the dowel bars (49) within the dowel bar retainers (24). The transverse brackets (74) are adjustable within slotted holes (76) to accommodate different lengths of dowel bars (49). For additional adjustment slotted holes (77) are also included in the L-shaped projections (75).

If it is desired to adjust the lateral distance between adjacent dowel bars in the concrete (14), for the embodiment shown in FIG. 11, the dowel bar retainers (24) can be adjusted by removing the bolts (73) and putting them into different openings (29). In the alternative embodiment, shown in FIG. 11*a*, the rearwardly cantilevered brackets (72) are clamped to a beam (30') through the use of a clamping plate (78) and bolts (73). This arrangement allows the retainers (24) to be clamped in any number of positions rather than in the predetermined locations set by the spacing of the openings (29). It should be understood that any lateral adjustment to the position of dowel bar retainers (24) requires a corresponding adjustment in the lateral position of the insertion forks (28) (discussed below).

Figure 1:
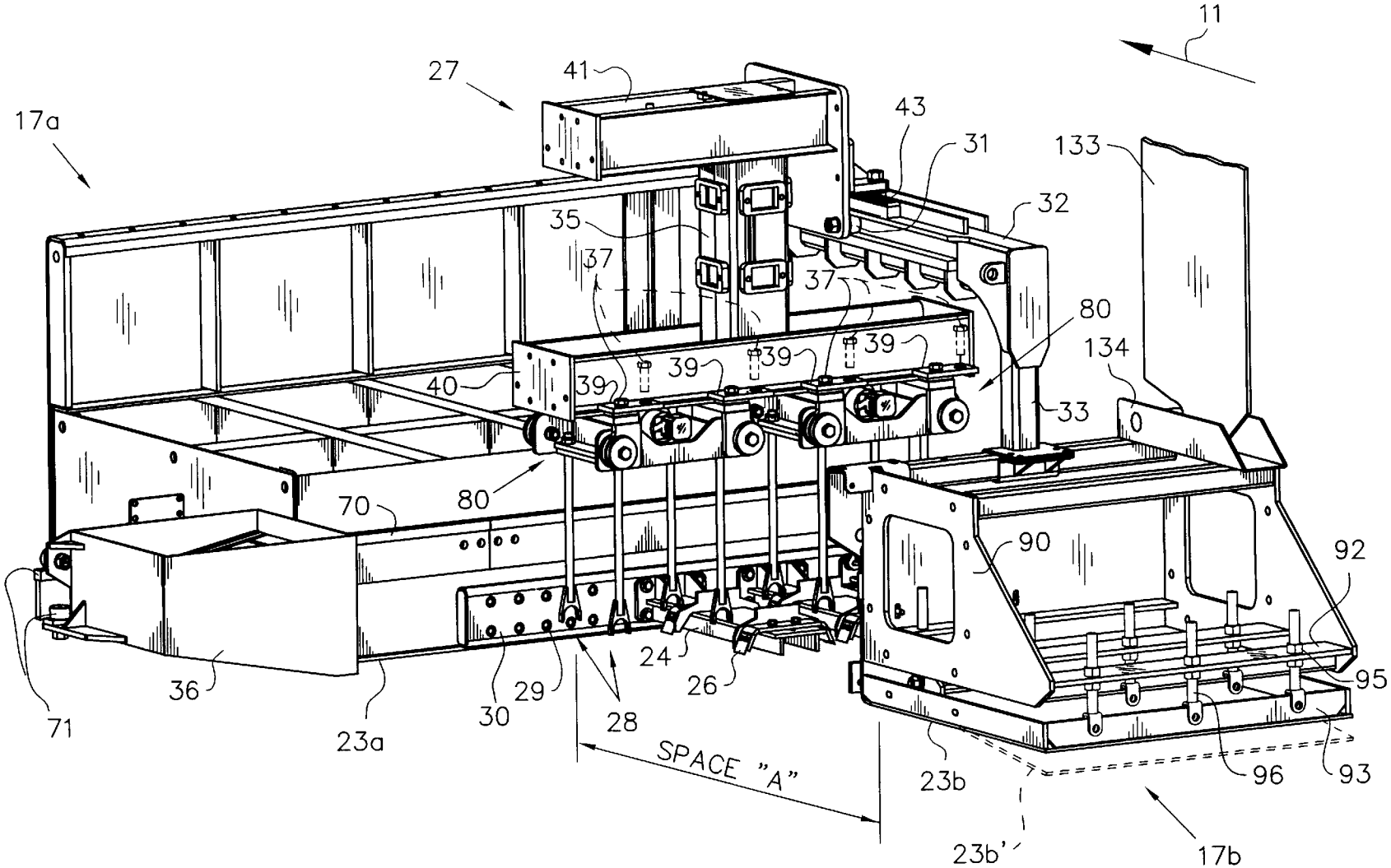
FIG. 1 is perspective view of a portion of the dowel bar insertion mechanism attached to the front pan portion and a section of the rear pan portion.
Figure 4:
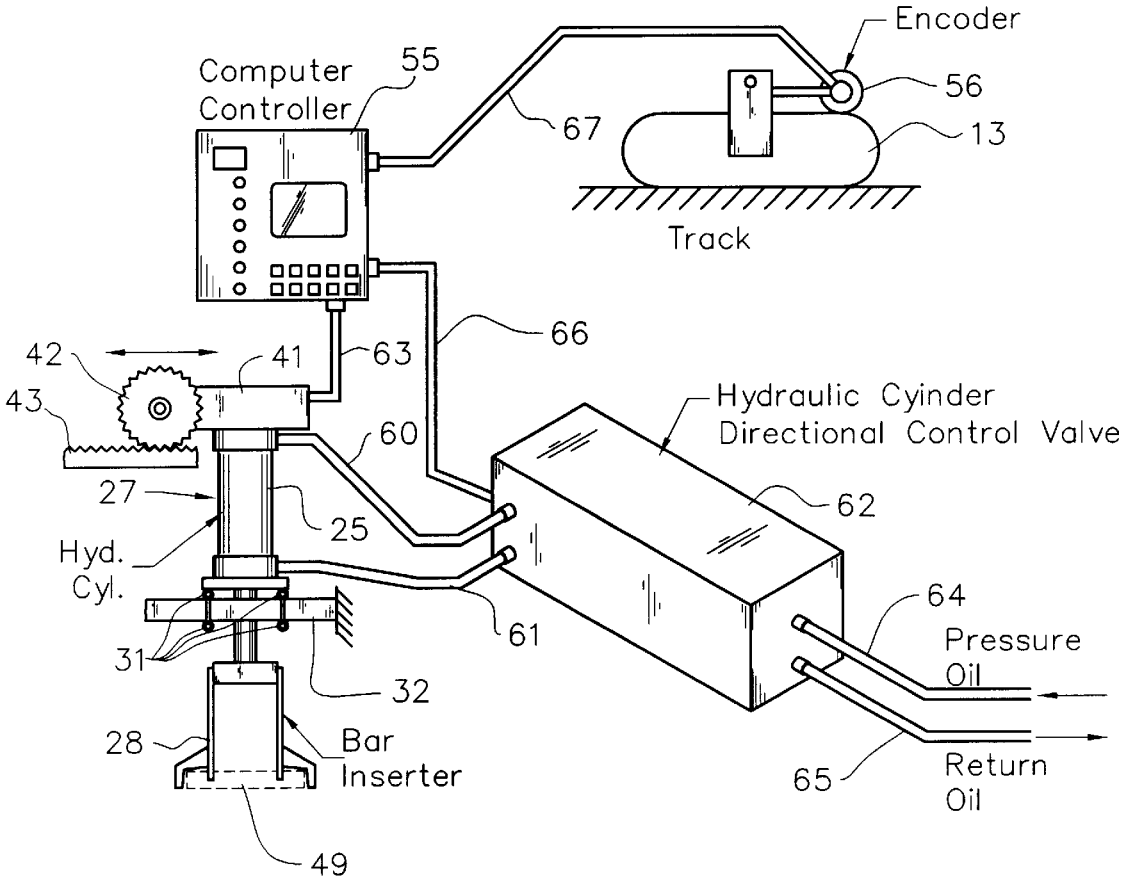
FIG. 4 is a schematic view of the system to insert dowel bars.

Referring to FIGS. 1, 2, 3, 7 and 9 longitudinal beams (32) at each end of the machine (10) are disposed above the space "A" between front and rear pan portions (17*a* and 17*b*) and are supported by vertical struts (33) attached to said front and rear pan portions (17*a* and 17*b*) (best illustrated in FIGS. 2 and 9). The beams (32) act as rails for a transverse beam (41) which supports the dowel bar insertion mechanism (27) as best illustrated in FIG. 1. The transverse beam (41) is supported at its ends by rollers (31) which ride along the flanges of the longitudinal beams (32) and is therefore moveable, front to rear, along the length of the longitudinal beams (32) by a gear and toothed rail mechanism (42 and 43). Disposed below the length of the transverse beam (41) is a rod (34) (see FIGS. 3, 6 and 7). This rod has a gear (42) rigidly attached to each end thereof. This gear (42) engages a toothed rail (43) mounted to the top of longitudinal beams (32) at each end of the machine (10). A motor (44) through a chain sprocket (45) rotates the rod and therefore the gears (42) which in turn moves the transverse beam (41) along the toothed rail (43) front to rear within the space "A". FIG. 2 illustrates the movement of the dowel bar insertion mechanism (27) from a rearward position (shown in hidden lines) to a forward position (shown in solid lines). The motor (44) is connected to a computer controller (55) as shown in FIG. 4. The controller (55) monitors the speed and position of the tracks (13) through an encoder (56) connected to the controller (55) by signal cable (67). This information is fed into the computer controller (55) to operate the motor (44) and hydraulic cylinders (25) at appropriate times. This procedure is discussed in further detail below.

The dowel bar insertion mechanism (27) is comprised of a pair of telescoping arms (35) actuated by hydraulic cylinders (25). The downward end of the telescoping arms (35) terminate onto a second transverse beam (40), to which is attached multiple fork assemblies (80). The fork assemblies (80) are mounted to the bottom flange of the second transverse beam (40) by brackets (39) and bolts (37).

Figure 12:
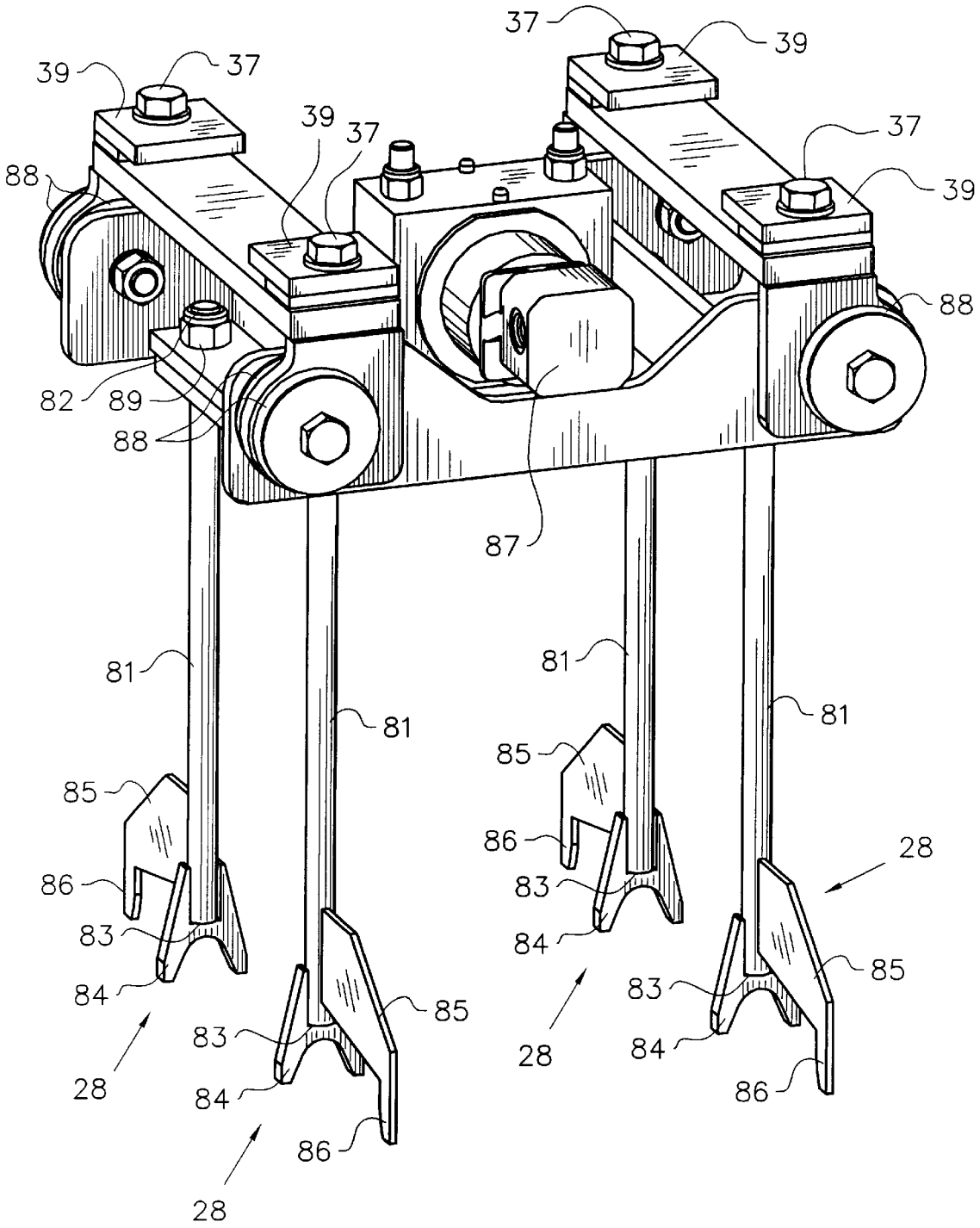
FIG. 12 is a detailed perspective view of a fork assembly.

As best shown in FIG. 12, each fork assembly (80) includes a set of front and rear forks (28) mounted to the body of the fork assembly (80). Each fork (28) includes a vertical rod (81) having a threaded upward projecting end (82) and a downward projecting end (83). The threaded upward projecting end (82) of the rod (81) is attached to the body of the fork assembly (80) by a nut (89). Rigidly attached to the downward projecting end (83) of the rod (81) is a V-shaped plate (84) oriented transversely to the direction of the dowel bars (49) within the dowel bar retainers (24). A second plate (85) is also rigidly attached to the downward projecting end (83) of the rod (81) perpendicular to the V-shaped plate (84). These second plates (85) having one end terminating in a finger-like projection (86) are oriented on each set of forks (28) such that the finger-like projections (86) oppose each other. The two plates (84 and 85) are designed to fit over the dowel bars (49) within the dowel bar retainers (24) such that the dowel bars (49) are restrained within the V-shaped plates (84) laterally and within the finger-like projections (86) longitudinally, (as shown in FIG. 2) thereby enabling the dowel bars (49) to be positioned within the concrete slab (14) within very strict tolerances.

It should be understood that the distance between adjacent dowel bar retainers (24) is sufficient to clear the width of the V-shaped plate (84) as the insertion forks (28) are forced downwardly between the adjacent dowel bar retainers (24). This operation is discussed below. It should also be understood that any adjustment to the position of dowel bar retainers (24) requires a corresponding adjustment in the lateral position of the fork assemblies (80) which can be done by moving the bolts (37) to a different opening in brackets (39) as shown in FIG. 1, or by other mechanisms to make the adjustment correspond to the position of the dowel bar retainers (24).

In addition to the above elements of the fork assembly (80), each individual fork assembly (80) includes hydraulically actuated form vibrators (87) mounted thereto. The preferred form vibrators are of the type manufactured by Minnich Manufacturing Co. Inc. of Mansfield, Ohio. Although hydraulic vibrators are preferred, pneumatic or electric vibrators may be used. It is necessary to vibrate the insertion forks (28) to consolidate the concrete around the dowel bars (49) as they are being inserted into the concrete. As best shown in FIG. 12, each bracket (39) is isolated from the body of the fork assembly (80) by annular resilient cushioning rings (88) (preferably a rubber type material) to dampen the effects of the vibrating forks on the mounting brackets (39).

In regard to the vibration of the fork assemblies (80), it has been determined that round bars are preferred for the vertical rods (82) of the fork assemblies (80) rather than rectangular bars. Round bars are preferred because they are symmetrical about their longitudinal axis and therefore the vibrating action of the round bars is unrestricted, thereby creating a 360 degree conical vibration pattern. A rectangular bar however, will tend to vibrate only side to side, because the vibrating action will be dampened in the direction of the long side of the bar.

As mentioned previously, it should be understood that the horizontal frame members (15) are moveable up or down along the vertical legs (16) by hydraulic cylinders (not shown). Therefore, all the components and mechanisms which are used to form the concrete slab (14) and insert the dowel bars, likewise move up or down with the horizontal frame members (15), since they are all operably connected to the horizontal frame members (15), thereby enabling the machine (10) to lay various thicknesses of concrete slabs. Additionally, because the pan mold forms (17*a* and 17*b*) are modular, the paving width of the machine (10) can be increased by adding additional sections of the front and rear pan portions (17*a* and 17*b*) as discussed above, along with additional sections to transverse beams (40 and 41), and trolley rail (70) and the retainer support beam (30), along with additional fork assemblies (80) and dowel bar retainers (24).

In operation, and referring to FIGS. 2, and 8, the forward direction of the machine (10) is shown by arrow (11). As the machine moves forward, the fresh concrete previously placed in front of the machine (10) is distributed across the width of the machine (10) between side forms (17*c*) by a first auger (18). A strike-off bar (19) is positioned behind the first auger (18) to level the concrete to a uniform thickness. A plurality of bent paving vibrators (20) following the strike-off bar (19) consolidates the concrete creating an even more uniform thickness. The preferred bent paving vibrators (20) are of the type manufactured by Minnich Manufacturing Co. Inc. of Mansfield, Ohio. A second auger (21), following the bent paving vibrators (20) is positioned to redistribute the concrete from any high spots to any low spots. A vertically oscillating tamper bar assembly (110*a*) following the second auger (21) and mounted to the forward end of the front pan portion (17*a*) tamps the concrete as the machine (10) moves forward.

As the slip forming machine (10) moves in a forwardly direction, the concrete is molded by the side forms (17*c*) and the concrete pan forming surface (23*a*) of the front pan portion (17*a*). The pan forming surface (23*a*) creates a smooth top surface to the concrete as it passes. The continued forward movement of the machine (10), exposes the concrete in the space "A" between the front and rear pan portions (17*a* and 17*b*).

At this time, the dowel bar insertion device (27) is in a rearward position, just ahead of the rear pan portion (17*b*). While the machine (10) is moving forward, a signal is sent from the controller (55) to actuate the trolley (36) which travels across the width of the machine (10) on rails (70), best seen in FIGS. 1 and 2, automatically depositing dowel bars (49) in the dowel bar retainers (24) in the manner shown in the Bengford, et al., patent referred to above. After the dowel bars (49) have been deposited into the dowel bar retainers (24), the trolley (36) returns to its original starting position outside of the side forms (17*c*) and out of the way of the dowel bar insertion device (27).

After the trolley (36) has deposited the dowel bars (49) in the dowel bar retainers (24), the controller (55) will send a signal through a signal cable (63) (shown in FIG. 4) actuating the motor (44) and chain sprocket (45) thereby causing the rod (34) positioned below the transverse beam (41) to rotate. The gears (42) rigidly attached to the ends of the rod (34) will engage the toothed rail (43), mounted to the longitudinal beams (32), thereby causing the transverse beam (41), supporting the dowel bar inserter (27), to move forwardly along the horizontal beam (32) until the dowel bar inserter (27) is positioned over the dowel bar retainers (24), holding the previously loaded dowel bars (49). When it is time for the dowel bars to be inserted into the slab (14), the computer controller (55) will send a signal through a signal cable (66) (see FIG. 4) to open the hydraulic fluid directional control valve (62). Hydraulic fluid will flow to and from the hydraulic cylinder (25), connected to the telescoping arm (35) of the dowel bar insertion device (27), to and from the directional control valve (62) through hydraulic lines (60 and 61). Note, lines (64) and (65) are pressure and return lines respectively which are connected to the hydraulic fluid holding tank mounted on to the frame (12). The movement of the hydraulic fluid to and from the cylinder (25) causes the piston of the hydraulic cylinder (25), connected to the telescoping arm (35) of the dowel bar insertion device (27), to extend, thereby forcing the second transverse beam (40), to which is mounted the fork assemblies (80), to move downwardly. The forks (28) of the fork assemblies (80) engage the dowel bars (49) within the dowel bar retainers (24). The continued downward movement of the forks (28) forces the dowel bars (49) through the spring tabs (26) of the dowel bar retainer (24) and into the concrete (14). This action is similar to that shown in FIG. 5 of the Godbersen U.S. Pat. No. 5,209,602. The resilient spring tabs (26) will spring back to their original position, ready to receive another dowel bar. When the dowel bars (49) are inserted into the concrete (14) at the desired depth (see FIG. 2), the controller (55) closes the directional control valve (62) stopping the downward movement of the forks (28). At the same time that the dowel bars (49) enter the concrete, the controller (55) again sends a signal to the motor (44) actuating the rod (34) and gears (42) to rotate in the opposite direction as before, thereby moving the transverse beam (41) and dowel bar insertion device (27) rearward along the longitudinal beam (32) at the same speed but in the opposite direction as the forward motion of the machine (10). Thus, the forks (28) will remain stationary within the concrete slab (14) relative to the point of insertion while the machine (10) continues its forward movement. This action prevents the dowel bars from being dragged along within the concrete slab as the machine (10) continues its forward movement.

As soon as the dowel bar (49) reaches the desired depth within the concrete, a signal is sent by the controller (55) to the dowel bar inserter mechanism (27) to actuate the hydraulic cylinder (25), causing the telescoping arm (35) of the dowel bar insertion device (27) to telescope up, thereby removing the forks (28) from the concrete slab (14), leaving the dowel bars (49) behind within the concrete slab (14) at the appropriate depth. As the forks (28) are being withdrawn from the concrete, the dowel bar inserter (27) continues to move rearwardly along the toothed rail (43) until it reaches the end. The removal of the forks (28), leaves the once smooth concrete surface scarred where the dowel bars (49) were inserted. This scarred surface is corrected by the action of the second vibrating and oscillating tamper bar assembly (110b) and the concrete pan forming surface (23*b*) of the rear pan portion (17*b*) as it passes over the concrete, leaving behind it once again a smooth, formed concrete surface. This procedure is repeated again and again along the length of the slab (14).

Figure 5:
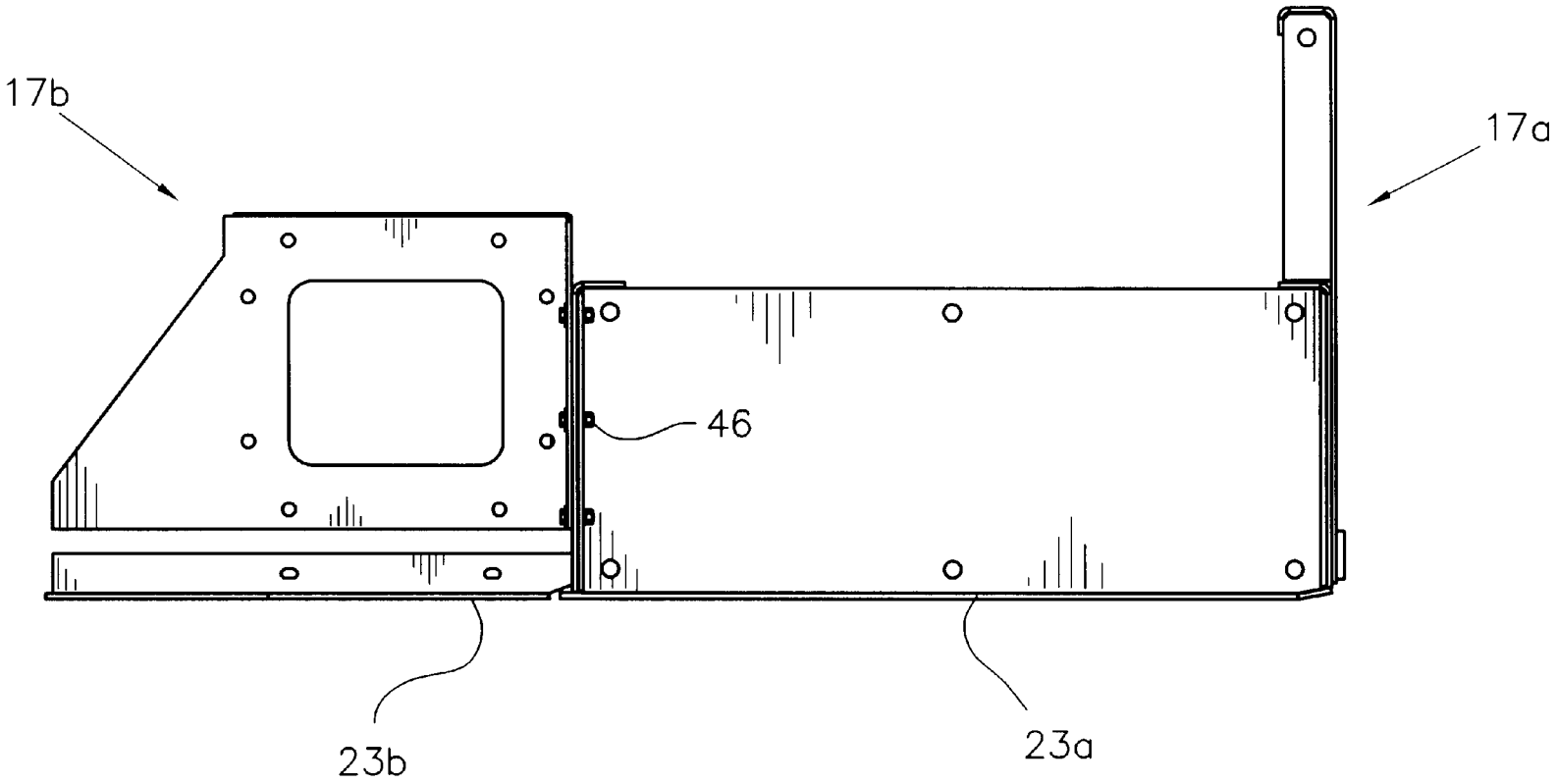
FIG. 5 is a side elevation view of the front and rear pan portions with the dowel bar retainers, inserter and trolley removed and the front and rear pan portions of the pan mold bolted together.

When it is desired to utilize the slip forming machine without utilizing the dowel bar inserter (27), the front and rear pan portions (17*a* and 17*b*) are unbolted from the overhead structure and the dowel bar inserter (27) is removed. The rear pan portion (17*b*) is then attached to the front pan portion (17*a*) by bolts or threaded fasteners (46) as shown in FIG. 5. In the FIG. 5 configuration, the slip forming machine (10) can be utilized without inserting dowel bars. The advantage of this adjustment is that the slip forming machine (10) can be purchased in the FIG. 5 configuration without the additional expense of the dowel bar inserting mechanism (27) and then, at a later time, the insertion mechanism (27) can be purchased. Alternatively, a contractor who knows that he may need to use a dowel bar inserter at some time but knows that it is not required at other times can derive significant economic benefit from having this adjustable feature which allows the dowel bar inserter to be used or not used.

Accordingly, it will be appreciated that the preferred embodiment shown herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A concrete slip forming apparatus comprising:

a frame, said frame being adapted to be moved in a forward direction;

a mold attached to said frame for forming concrete in a plastic condition into a continuous concrete slab, said mold having a front pan portion, a rear pan portion and continuous side forms supported by said front and rear pan portions, said front pan portion being greater than three feet long where it contacts the concrete slab;

a vibrating mechanism operatively attached to said frame for consolidating the concrete as said mold forms the concrete slab;

a dowel bar inserter, said inserter being operably attached to the frame for pushing dowel bars into the formed concrete slab;

an actuator for causing said inserter to insert dowel bars at predetermined places in said concrete slab whereby said dowel bars can be positioned within the concrete across the width of the formed concrete slab; and wherein said front pan portion and said rear pan portion of said mold are spaced apart to form a space therebetween, said dowel bar inserter being disposed above said space and whereby the dowel bars are inserted into the formed concrete below said space.

2. The apparatus of claim 1 wherein said rear pan portion is greater than two feet long where it contacts the concrete slab.

3. The apparatus of claim 2 wherein the rear pan portion is approximately three feet long where it contacts the concrete slab.

4. The apparatus of claim 2 wherein the front pan portion is longer than the rear pan portion.

5. The apparatus of claim 2 wherein the front pan portion is approximately four feet long and the rear pan portion is approximately three feet long.

6. The apparatus of claim 1 wherein said front pan portion is approximately four feet long where it contacts the concrete slab.

* * * * *